US010279599B2

(12) United States Patent
Till

(10) Patent No.: US 10,279,599 B2
(45) Date of Patent: May 7, 2019

(54) METHOD FOR PRINTING SURFACES OF THREE-DIMENSIONAL OBJECTS AND THREE-DIMENSIONAL OBJECTS HAVING PRINT

(71) Applicant: Till GmbH, Kelkheim (Taunus) (DE)

(72) Inventor: Volker Till, Hofheim am Taunus (DE)

(73) Assignee: TILL GMBH, Kelkheim (Taunus) (DE)

( * ) Notice: Subject to any disclaimer, the term of this patent is extended or adjusted under 35 U.S.C. 154(b) by 0 days.

(21) Appl. No.: 15/021,338

(22) PCT Filed: Sep. 15, 2014

(86) PCT No.: PCT/EP2014/069599
§ 371 (c)(1),
(2) Date: Mar. 11, 2016

(87) PCT Pub. No.: WO2015/036588
PCT Pub. Date: Mar. 19, 2015

(65) Prior Publication Data

US 2016/0221359 A1 Aug. 4, 2016

(30) Foreign Application Priority Data

Sep. 13, 2013 (DE) ..... 10 2013 015 098

(51) Int. Cl.
*B41M 1/40* (2006.01)
*B41J 3/407* (2006.01)
(Continued)

(52) U.S. Cl.
CPC ..... *B41J 3/4073* (2013.01); *B41J 11/0015* (2013.01); *B41M 1/40* (2013.01); *B65D 1/165* (2013.01)

(58) Field of Classification Search
CPC ..... B41M 1/40; B41M 1/42; B41M 3/008; B41M 2205/00; B41M 2205/40;
(Continued)

(56) References Cited

U.S. PATENT DOCUMENTS 6,048,595 A 4/2000 Nakajima et al.
6,135,654 A * 10/2000 Jennel ..... B41J 2/01 101/35
(Continued)

FOREIGN PATENT DOCUMENTS

DE 4438536 A1 5/1996
EP 2792474 A1 10/2014
(Continued)

*Primary Examiner* — Leslie J Evanisko
(74) *Attorney, Agent, or Firm* — Leydig, Voit & Mayer, Ltd.

(57) ABSTRACT

A method for printing on surfaces of three-dimensional objects with a cylindrical or curved surface by means of inkjet print heads includes printing a base color layer onto the three-dimensional object. Then, an upper color layer is printed above the base color layer. The base color layer is printed smaller than the upper color layer. The dimensions of the base color layer are less than the dimensions of the upper color layer in all directions on the surface of the three-dimensional object such that the upper color layer securely covers a margin of the lower base color layer.

13 Claims, 1 Drawing Sheet

(51) Int. Cl.
*B41J 11/00* (2006.01)
*B65D 1/16* (2006.01)

(58) Field of Classification Search
CPC ..... B41M 2205/36; B41M 2205/38; B41M 2205/42; B41M 1/18; B41J 3/4073; B41J 2/2114; B41J 2/117; B41F 17/28; B41F 17/08; B41F 17/006; B41F 17/30; B41F 17/32; B41F 17/34
USPC ..... 347/4; 101/35, 41, 38.1
See application file for complete search history.

(56) References Cited

U.S. PATENT DOCUMENTS

| | | | | |
|---|---|---|---|---|
| 6,210,776 | B1 * | 4/2001 | Hill | B41M 1/18 428/187 |
| 6,526,681 | B1 * | 3/2003 | De Saro | G09F 13/04 40/564 |
| 8,522,989 | B2 | 9/2013 | Uptergrove | |
| 2007/0264454 | A1 | 11/2007 | Uptergrove | |
| 2013/0100186 | A1 * | 4/2013 | Kumagai | B41J 2/2117 347/9 |
| 2015/0165830 | A1 | 6/2015 | Hajikano | |

FOREIGN PATENT DOCUMENTS

| | | |
|---|---|---|
| WO | WO 2010104707 A1 | 9/2010 |
| WO | WO 2011064075 A2 | 6/2011 |
| WO | WO 2013088950 A1 | 6/2013 |

* cited by examiner

METHOD FOR PRINTING SURFACES OF THREE-DIMENSIONAL OBJECTS AND THREE-DIMENSIONAL OBJECTS HAVING PRINT

CROSS-REFERENCE TO PRIOR APPLICATIONS

This application is a U.S. National Stage Application under 35 U.S.C. § 371 of International Application No. PCT/EP2014/069599 filed on Sep. 15, 2014, and claims benefit to German Patent Application No. DE 10 2013 015 098.1 filed on Sep. 13, 2013. The International Application was published in German on Mar. 19, 2015 as WO 2015/036588 A1 under PCT Article 21(2).

FIELD

The invention relates to a method for printing the surface of three-dimensional objects, with a cylindrical or curved surface such as bottles or cans, by means of inkjet print heads, i.e. a digital printing method in which a preferably white or differently colored, especially opaque, base color layer is applied to the three-dimensional object and a further color layer is printed thereon. Furthermore, a three-dimensional object printed accordingly, especially a container such as a bottle or can is described.

BACKGROUND

Printing machines are known that print curved surfaces with drop-on-demand inkjet print heads. Usually, in this method, colors are printed consecutively as cyan (C), magenta (M) and yellow (Y) with black (K) onto the object with the curved surface moved relative to the inkjet print heads to create the color impression and/or the colored print image on that surface. For transparent subsurfaces, e.g. bottles made of plastic or glass, usually a base color layer is printed first, often in white, in order to create better opacity. Basically, other colors may be used for this as well which basically may also contribute to the graphic print image of the color layer.

U.S. Pat. No. 8,522,989 B2 describes digital printing of three-dimensional bodies with particularly a curved surface during which a base layer is at least partially applied onto the three-dimensional body. This base layer may be transparent or opaque. On this base layer, additional elements such as labels can be printed for the graphic design. This creates a three-dimensional effect that makes the label stand out from the base layer. As a further design element, a type of inverse printing is described that leaves specially formed gaps free during the printing of the base layer. This creates an effect through which the elements created due to the missing base layer seem to be set back compared to the base layer. The base layer that differs in particular in color and/or in its thickness/brightness from the three-dimensional object is therefore consciously used for contrasting design elements according to the teaching of U.S. Pat. No. 8,522,989 B2. The margins of the base layer and/or the print application are consciously intended to create a three-dimensional effect and be visible.

This is, however, a disadvantage if the basically, for example, transparent three-dimensional object should not receive an extensive, for example opaque base color layer because the view of the product contained in the object should be maintained. This is, for example, often the case for transparent beverage bottles if those should only be printed with a label or an inscription, possibly in several colors, or the three-dimensional object should not be coated anywhere else than the print image (print area) for other reasons, e.g. because of a particularly high-quality surface. In such cases it is not desired that the base color layer (that usually has a different color, especially white) shines through on the margins of the print image. This effect in particular occurs due to the relative movement between the surface of the three-dimensional object to be printed and the ink drop that hits this surface.

In some circumstances, that relative movement may be quite large. Those objects are rotated at a high speed in front of the inkjet print heads working with the drop-on-demand method in printing machines made for printing rounded, especially cylindrical, objects such as, preferably, bottles or cans to which the method suggested according to an embodiment of the invention refers in particular. The consequence is that the drop on the surface is not circular and round and, e.g. flows evenly over the margin of a previously applied layer, e.g. the base color layer, covering its margin, but is smudged against the relative movement, and consequently distorts. On the surface, the resulting contours are shaped more like a drop. This is not pleasant because, in this case, especially in case of a basically color-neutral first white print that does not influence the printed color with a color cast, because there is a "flash" of the color white on the margin of the print image. The white (or differently colored) first base color layer is visible underneath the actual color.

This is visible in FIG. 1, which schematically shows the print 11 on a three-dimensional object 12 as the result of a traditional print method. For improved ink adhesion, a primer 13 has been applied directly on the surface of the object 12 as an adhesive primer. On the primer 13, the (especially white) first base color layer 14 has been applied, which is then printed with the color layer 15 in several colors during several printing runs as a structured print image. The color layer is protected by a coating 16 in the sense of a varnish and/or top coat. On the sides indicated with an arrow, the white (or differently colored) base color layer 14 is visible underneath the actual color.

It is furthermore known that in the case of different materials underneath the base color layer, an adhesive base usually referred to as primer is printed or otherwise applied. In addition, a coating, also referred to as varnish/top coat in the sense of a coating varnish in order to generate certain characteristics, may be printed or otherwise applied after the printing of the three-dimensional object with the actual print image. This coating is intended to protect the print image against damage. The coating is usually a varnish paint, but may also consist of a different material according to an embodiment of the invention, e.g. a transparent and preferably also color-neutral plastic layer in the sense of a plastic coating. The primer 13 and the coating 16 are also depicted in FIG. 1.

All these applications and/or layers, especially print layers applied with print methods, share the characteristic that they are directly copied by the print image, especially with regard to their size, i.e. their dimensions. This results in print images with a common size and dimensions on the three-dimensional, curved surfaces for each applied layer, which are printed one over the other. The disadvantage of the traditional application of the individual applied layers is, therefore, that the margins of the individual application layers are free and not only visible, but also in an area where they are vulnerable to exterior influences DE 44 38 536 A1 discloses a method for the sectional coating of a transparent carrier plate with an active layer applied in a roll stamping procedure. In this process, a protective layer is applied to the active layer and other layers, if applicable, so that the active layer and the possible further layers in those areas are resistant against chemical etching. During an etching process the active layer and the possible further layers are etched away only in the area not covered by the protective layer, and the protected area remains.

WO 2011/064075 A2 discloses a method and an apparatus for the generation of a three-dimensional surface structure on a work piece.

WO 2010/104707 A1 describes an electro-luminescence structure with an electrode layer, a phosphorus layer above the electrode layer and a transparent electrode layer above the phosphorus layer. Two protective layers are additionally applied from both sides to protect the electro-luminescent structure.

U.S. Pat. No. 6,048,595 discloses a light-storing layer that is printed over with another transparent protective layer that allows writing on it. The layers are created in a screen printing procedure or with a transfer print.

WO 2013/088950 A1 describes a method for printing on the domed sides of car tires in which a print head with a plurality of nozzle groups is laterally shifted during printing, relative to the print image. This results in a staggered total structure of the print image in which each part of the image is printed several times on top of each other by different nozzle groups.

SUMMARY

In an embodiment, the present invention provides a method for printing on surfaces of three-dimensional objects with a cylindrical or curved surface by inkjet print heads. A base color layer is printed onto the three-dimensional object. Then, an upper color layer is printed above the base color layer. The base color layer is printed smaller than the upper color layer. The dimensions of the base color layer are less than the dimensions of the upper color layer in all directions on the surface of the three-dimensional object such that the upper color layer securely covers a margin of the lower base color layer.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
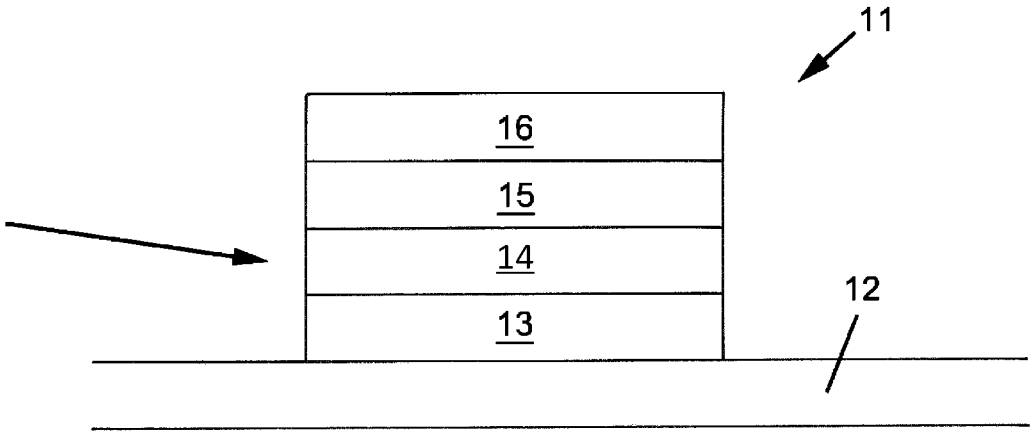
Fig. 1 (Prior Art)
FIG. 1 a schematic profile view of a print on a three-dimensional object according to the prior art.

In an embodiment, invention qualitatively improves the print image created on the surface of a three-dimensional object (especially with a curved, e.g. cylindrical, surface) by digital printing with inkjet print heads.

The upper color layer in an embodiment of the present invention may consist of one or several colors that are printed in one print layer with an inkjet print head or in several print layers with several inkjet print heads of different colors as a mixed color and can possibly result in a preferably structured image. As a complement or an alternative to the additional color layer, a coating, especially consisting of one or several transparent or semi-transparent, colorless or colored varnish paints, may be applied. The coating may occur especially by printing, e.g. with an inkjet print head working with the digital print method. As an alternative, other, basically known coating methods may be applied for the coating, e.g. a spray coating.

In an embodiment, the base color layer forming especially the first color layer is printed smaller than the color layer above and/or the coating above. The individual layers are consequently generated according to an embodiment of the invention from different print indications, especially with regard to the size of the area to be printed and/or coated, in such a way that the disadvantages described above are avoided. By printing the color layer that is printed on the first color layer bigger than the first color layer, it preferably covers the first color layer in all directions, causing the latter to no longer appear on the margins of the print image as an annoying margin.

According to an embodiment of the invention, it is therefore intended that the first color, e.g. as a white color layer (also referred to as the base color layer), be printed smaller than the image above, consisting of other colors that are printed in the additional color layer. This prevents the white (or differently colored) base of the first color layer from showing on the sides, or flashing, from the other colors that predominantly or fully determine the print image. The difference in size in the prints of the individual layers usually amounts to only a few pixels. Those do not distort the print in any optically noticeable way.

In the case of flat prints, the problem of flashing usually does not occur in any optically disturbing way. On curved surfaces, however, the individual color layers are found on different radii of curvature due to the thickness of the layer below, causing the print image to be smaller in its angular dimension with each color layer and the color layer below to flash, i.e. become more visible. This flashing and/or visibility can be avoided by an embodiment of the invention.

It is furthermore suggested according to a preferred embodiment according to the invention that a coating be printed on the color layer. This may occur directly on the color layer or indirectly, i.e. after applying, if applicable, another intermediate layer such as a masking, a safety characteristic or similar. The coating preferably creates the top layer after printing, i.e. the top layer on the finished printed and/or processed object, especially in the sense of an object ready for use. The coating in this sense therefore creates a protective layer for the layers applied below it (such as especially the color layer and the first color layer also referred to as the base color layer). The coating is therefore also referred to as the cover or protective varnish layer (varnish/top coat). The term coating in this text may therefore have especially this meaning. In this sense, the top coat (varnish/top coat), in its characteristics according to an embodiment of the invention, may be executed in such a way that it especially protects the colors against water, since the inks of the inkjet print heads usually used are based on an acrylate basis and have only limited resistance against water.

In this context, it may be provided according to an embodiment of the invention that the coating is wider than the (especially image-creating) color layer and/or the base color layer. Wider according to the invention should be understood to mean that the dimension of the coating extends over the dimension of the color layer in at least one direction, though preferably in all directions on the surface of the three-dimensional object. The same applies to the base color layer. Since the coating or protective varnish layer (varnish/top coat) is wider and/or larger than the actual print image of the color layer creating the print, the open margins of the print image are thus also protected.

Another, especially preferred embodiment of the method suggested provides that the first color layer and/or base color layer is printed and/or designed smaller than the color layer and/or the coating. The color layer may be made of several color layers above the first color layer and/or base color layer. This also covers the margin of the base color layer with the color layer and/or the coating. Smaller according to the invention should be understood to mean that the dimensions of the first color layer (also referred to as the base color layer in the context of the disclosure) are less than the dimensions of the color layers applied later (in the context of the disclosure also referred to with the generic term of color layer) in at least one direction, though preferably in all directions on the surface of the three-dimensional object. In other words, the color layer (applied later) is wider than the base color layer or first color layer in the sense that the extension of the color layer exceeds the extension of the first color layer in at least one direction, though preferably in all directions on the surface of the three-dimensional object. The same applies to the coating with regard to the first color layer and/or the color layers above it.

According to an embodiment of the invention, this results in a preferred arrangement in which the print image mainly created by the color layer exceeds the lateral margins of the base color layer and covers a visible lateral margin of the base color layer. In the print image, the base color layer may also, for example, be used according to the invention in order to create a visible background color or one color of a multi-colored print image. Inasmuch as only a monochrome color design is required for the print image, the base color layer (in the print design wanted) may be directly printed onto the surface of the three-dimensional object or a primer intended for it. In such an application, the additional color layer is not present.

A coating applied above the color layer, especially printed, which consists of, for example, a protective varnish layer and acts as a varnish/top coat, in turn covers the color layer and/or the base color layer and thus creates protection both for the surface and the margins of the color layer with the print image. If the color layer is not present, the same applies to the base color layer.

The relative size indication "wider" (synonymous with "larger") or "smaller" (synonymous with "narrower") in this context should therefore be understood to mean that the respective top layer securely covers the margins of the respective layer (directly or indirectly) below (with regard to the layers "base color layer", "color layer" and "coating"). According to an embodiment of the invention, this usually does not refer to a larger covering of the lower layer by the respective layer above it. The margin of the respective layer protruding beyond the lower layer therefore should not be much larger, according to an embodiment of the invention, than is required to cover the margin. One exception to this might be the coating which, in addition to its protective function for the lower protective layers, may also have a protective function for the surface of the three-dimensional object and may cover it completely or at least beyond the actual print image.

The required dimensions will be selected by experts, especially taking into account the printing machine and the printing ink and/or varnishes or print paints used and their print characteristics during application, possibly by trial runs of printing and/or application. In such cases it is advantageous if the dimensions of the covering can be parameterized in the method in order to adapt the method to various fields of application.

For this purpose, the base color layer with regard to the print resolution of the color layer expressed in pixels in the sense of pixel points and defined by the construction and the controls of the inkjet print heads in relation to the relative movement to the object may be in the range of 1 to 100, preferably 5 to 30 pixels smaller than the color layer. This is sufficient to make the color layer cover the base color layer. The same can apply to the other layers.

In a similar way it may therefore be arranged that the coating with regard to the print resolution of the color layer, expressed in pixels and defined by the construction and the controls of the inkjet print heads in relation to the relative movement to the object, is larger than the color layer in the range of 1 to 100, preferably 5 to 30 pixels. This is sufficient to make the coating cover the color layer. As described above, the coating according to an embodiment of the invention may also be designed with larger dimensions in order to, for example, also capture other areas of the surface of the three-dimensional object in addition to the print image according to an embodiment of the invention; the print especially comprises any layers applied with the method according to an embodiment of the invention beneath the coating.

According to an embodiment of the invention, it is suggested that the color layer that represents the actual print image, i.e. possibly also containing a graphic element, be used as a reference for the size of the print, especially measured in "pixels", and that the base color layer be diminished with respect to this color layer while the coating is increased with respect to this color layer. If the color layer is, for example, missing in a monochrome print created with the base color layer, this base color layer is used as a reference value for the size of the print because it then defines the visible size of the print image created by the print. This results in a print image containing the motif to be printed that is not represented with any distortion. In more general terms, this may be described according to the principle of an embodiment of the invention in such a way that the layer determining the motif of the print image, especially a color layer, is the reference for the size, and the other layers are designed smaller or larger in the manner described. Those layers are increased on their sides by cutting off or adding marginal areas. It is important, according to an embodiment of the invention, that there be no scaling of the other layers, especially if those have a structure or motif effect that is visible in the completed print image.

As a supplement to the method described so far, according to an embodiment of the invention it is also possible to additionally apply a primer, also referred to as an adhesive primer, underneath the base color layer. This primer is preferably colorless and transparent in order to avoid any influence on the further design of the print and/or print image. Such a primer may be required—in a way that is basically known—on the texture of the surface of the three-dimensional object to be printed in order to ensure sufficient adhesion of the individual layers (base color layer and possibly other color layers) on the surface without smudging. The primer is therefore usually directly printed on or applied to the surface of the three-dimensional object.

Suitable primers vary accordingly depending on the subsurface and are known to experts in the field.

According to an embodiment of the invention, it is also possible to integrate the primer (especially in its function as an adhesive primer) into the base color layer. In that case, the additional primer layer becomes obsolete. In other words, the base color layer then represents a colored primer that may appear transparent or opaque.

The primer is preferably wider than the color layer and thus the colored print image created in that color layer in order to come into direct contact with the coating.

For this reason, the primer is preferably wider or narrower than the coating.

If the primer is wider or larger than the coating, the coating ends on the primer. When a transparent or semi-transparent adhesive primer is thus applied as a primer, the effect is thus that this primer is wider than the print image and also wider than a possibly applied transparent or semi-transparent top coat as a coating, so that there is sufficient adhesive primer for every layer or color layer above it. If the primer is, on the other hand, narrower or smaller than the coating, the coating covers the primer.

In any case, the base color layer and the color layer in this structure are encased by the coating and the primer so that the two layers (significantly determining the optical impression of the print image), i.e. especially the color layer and possibly the base color layer, as well as possible other layers not described here in detail, are well protected against environmental influences. According to an embodiment of the invention, an adhesive primer and/or a primer as the primer and a top coat as the coating should interact in such a way that the colors (color layer and base color layer) found between those two layers are, as it were, "sealed" in a package and thus perfectly protected against surrounding influences.

Since the primer is usually directly applied to the surface to be printed, it is preferred according to an embodiment of the invention if the coating is wider than the primer (and/or the primer smaller than the coating). In that case, the coating, which usually ensures the best protective effect with regard to exterior environmental influences, reaches directly down to the surface of the three-dimensional object. This prevents, for example, any solvents dissolving the primer from one side, extends underneath the base color layer and leads to dissolving the entire print or parts thereof from the printed surface.

With regard to the terms "wider", "larger", "narrower", "smaller" and the measurements for them, the same applies to the primer and its interaction with the other layers that has been stated above for the base color layer, the color layer and the coating, respectively. The same meaning of those terms also applies to the three-dimensional object described in the following.

Another embodiment of the invention provides a three-dimensional object designed as a container, having three-dimensional, cylindrical or curved surface contours, with a print on the surface of the container and the printing process of the print image being a digital printing process by means of inkjet print heads in several printing steps. The particular element is that layers created in consecutive printing steps and placed one above the other become wider as they get higher, so that they cover the margins of the layer below. The three-dimensional objects according to an embodiment of the invention are preferably bottles, cans or other, especially bottle-shaped containers that are printed in such a way that the aesthetics of those containers and/or bottles is retained with regard to the printing process suggested. This is achieved by having the color layers become narrower in order to avoid flashing of colors toward the inside (and/or as one color layer from one level to the level below). It is further suggested according to an embodiment of the invention to design the three-dimensional object in such a way that for transparent paints or varnish applied as transparent layers, i.e. as a varnish layer, become wider toward the outside compared to the layer of paints or varnish below, possibly with the exception of a possible lowest transparent or semi-transparent layer that should be wider than the layer above it. In other words, this results in a three-dimensional object for which, starting from a layer that graphically includes the print image, layers with color below that color layer are designed more narrowly going down and/or transparent or semi-transparent layers toward the top are designed more broadly.

By applying the method according to an embodiment of the invention, this specifically results in a three-dimensional object for which a color layer, starting with the surface of the three-dimensional object to be printed, a base color layer as a first colored and thus opaque layer and above it a second colored layer is arranged that possibly consists of several mixed colors printed consecutively to generate the print image, with the base color layer being more narrow than the color layer, and that starting from the surface of the three-dimensional object to be printed, a primer is provided as the first transparent or semi-transparent layer onto which the first and the second colored layer (i.e. the base color layer and the color layer) are applied and that a coating is provided as a second transparent layer that is applied onto the color layer and is wider than the primer that forms the first transparent or semi-transparent layer.

FIG. 1 described above shows a schematic view of a traditional print 11 on a three-dimensional object 12 whose surface is curved. The curve is not visible here due to the simplified representation in the section of the object 12.

A primer 13 as an adhesive primer for the following layers, a (usually white) base color layer 14, a color layer 15, possibly created with different colors in digital print and a coating 16 are applied one on top of the other (starting from the surface) to the surface of the three-dimensional object. The print image of the print 11 is (at least essentially and in its motif structure) determined by the color layer 15, which therefore determines the entire size of the print 11. Each of the layers 13, 14, 15 and 16 has the same size in the known prints as the image-creating color layer 15. Viewed from one side, it is therefore possible to discern the edges of all layers 13, 14, 15, 16 as indicated by the arrow. As long as the layers are (at least predominantly) transparent like the primer 13 and the coating 16, they do not disturb the overall visual impression. This is different for opaque, colored layers such as the base color layer 14 that is underneath the color layer 15 and is usually colored with a color-neutral white.

The consequence of this is that looking from one side (e.g. from the direction of the arrow indicated), the white base color layer 14 flashes through on the margins of the print image underneath the actual color layer 15 containing the print image. This flashing of color, which disrupts the visual impression, is even stronger when the surface is curved (not illustrated here for simplicity's sake).

Figure 2:
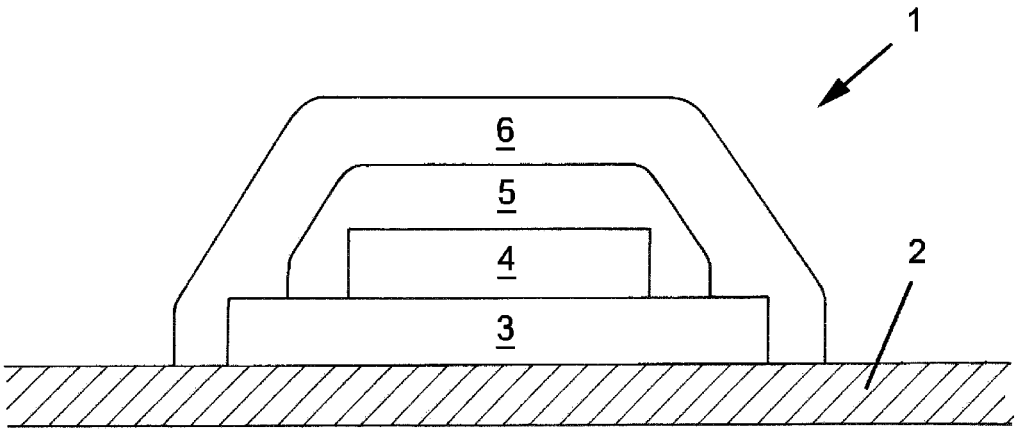
FIG. 2 a sectional view of a three-dimensional object with a print applied according to a preferred embodiment of the invention.

For the structure of a print 1, according to an embodiment of the invention, on a three-dimensional object 2 with a curved surface, those disadvantages are avoided, as can be seen in FIG. 2. To simplify the representation, a sectional view through object 2 and print 1 was selected for FIG. 2 as well, rendering the curvature of the object 2 invisible. Object 2 is preferably a bottle or can that is printed by means of inkjet print heads in a digital printing process.

The basic structure of print 1 is similar to the state of the art. Primer 3 is applied to the surface, and base color layer 4 is printed on it. Onto this opaque (preferably monochrome and having a variable brightness depending on its thickness) base color layer 4, the actual print image is printed as a motif in a digital printing process, usually with four inkjet print heads in the colors cyan (C), magenta (M), yellow (Y) and black (K). The base color layer may also be printed with the same inkjet print heads and the respective controls. Digital printing machines for this purpose are known to experts and therefore do not have to be described in more detail at this point.

Small ink points are sprayed next to each other onto the surface of the three-dimensional object 2 moved relative to the inkjet print heads in a digital printing process. Together those ink points create the print image. Mixed colors can be created by spraying ink points of different colors (C, M, Y, K) on top of each other. The resolution of the print depends on the size of the ink drops. This measure is also referred to as a pixel. Pixels are so small that they cannot be discerned with the human eye (at least not at a normal viewing distance). This creates the impression of a unified overall image.

It is important for this reason that the ink points sprayed onto the surface adhere well to it and do not smudge. Depending on the surface, this necessitates a treatment of the surface, e.g. by means of primer 3 that is applied and forms a good adhesive basis for the ink points. The type of primer 3 varies depending on the different surfaces. Experts know about suitable, especially transparent primers that do not interfere with the visual impression on different surfaces.

As can be seen in FIG. 2, this transparent primer 3 is now designed larger than the color layer printed on it, i.e. base color layer 4 and color layer 5 depicting the print image. This ensures that the ink sprayed onto the surface stays there and does not smudge. The primer itself may also be printed by means of an inkjet print head or applied to the surface by means of another known process in the size and shape desired. In this case, primer 3 is at least 1 to 10 pixels larger in each margin than color layer 5, which forms the largest color layer on primer 3.

Especially in the case of transparent objects 2, e.g. made of clear glass or clear plastic, it is important that the surroundings visible through the transparent items 2 do not interfere with the print image. For this purpose, a base color layer 4 is applied to the transparent primer 3 (which is usually white and thus does not influence other colors, but possibly differently colored), with the former ensuring the desired opacity. The desired degree of opacity may, for example, be adjusted via the thickness of the layer. This base color layer 4 is ideally also printed. The actual print image in color layer 5 is then printed onto this base color layer 4 as described.

The size of this color layer 5 is determined by the print image. In order to prevent the base color layer 4 from being visible, the base color layer 4 is printed a few pixels smaller than the print image or the color layer 5, respectively, in (all) margins of the print image, preferably between 1 and 10 pixels smaller. This leads to the color layer 5 extending beyond the base color layer 4 in the margins and covering it with the actual print image.

Finally, a coating 6 may be applied that is at least a few pixels larger than color layer 5, though preferably a few pixels larger than the primer 3. To repeat, a few pixels means 1 to 10 pixels. This case is shown in FIG. 2. Coating 6 thus encases all the layers applied below it onto the surface as a varnish or top coat and acts as a protective varnish. The coating may also be printed on or applied to the surface by means of another known process in the size and shape desired.

Coating 6 may be designed as a protective varnish on the surface of the three-dimensional object 2 itself possibly with much larger dimensions than layers 3, 4 and 5 below it.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 print image
2 three-dimensional object
3 primer
4 base color layer
5 color layer
6 coating
11 print image
12 three-dimensional object
13 primer
14 base color layer
15 color layer
16 coating

The invention claimed is:

1. A method for printing a print of a print image on a surface of a three-dimensional object with a cylindrical or curved surface by inkjet print heads, the method comprising:

printing a base color layer onto the three-dimensional object; and then printing an upper color layer above the base color layer, wherein the base color layer is printed smaller than the upper color layer, the dimensions of the base color layer being less than the dimensions of the upper color layer in all directions on the surface of the three-dimensional object such that the upper color layer securely covers a margin of the lower base color layer and forms a visible part of the print image outside of the margin of the lower base color layer, the upper color layer representing the print image and being a reference for a size of the print, wherein the base color layer with regard to print resolution indicated in pixels is smaller than the upper color layer by an amount in a range from 5 to 30 pixels.

2. The method according to claim 1, wherein a coating is printed over the upper color layer.

3. The method according to claim 2, wherein the coating is formed wider than the upper color layer and the base color layer.

4. The method according to claim 3, wherein the coating with regard to the print resolution indicated in pixels is larger than the upper color layer by an amount in a range from 1 to 100 pixels.

5. The method according to claim 3, wherein the base color layer is decreased with reference to the upper color layer and the coating is increased with reference to the upper color layer.

6. The method according to claim 1, wherein a primer is applied underneath the base color layer.

7. The method according to claim 6, wherein the primer is broader than the color layer.

8. The method according to claim 6, wherein the primer is narrower than the color layer.

9. The method according to claim 1, wherein the upper color layer represents the print image without distortion.

10. A container with three-dimensional cylindrical or curved surface contours, with a print on a surface of the container, the print being of a print image obtained in a digital print process by inkjet print heads in several printing steps, wherein layers created in consecutive printing steps are subsequently broader going upwards so that each subsequent layer covers margins of the layer below it, and wherein an upper color layer, which is increased with reference to a base color layer below the upper color layer, represents the print image and is a reference for a size of the print, the upper color layer forming a visible part of the print image outside of the margin of the base color layer, wherein the base color layer with regard to print resolution indicated in pixels is smaller than the upper color layer by an amount in a range from 5 to 30 pixels.

11. The container according to claim 10, wherein, starting from the upper color layer that graphically contains the print image, any transparent or semi-transparent layers are broader going upwards.

12. The container according to claim 10, wherein, starting with the surface of the three-dimensional object to be printed, the base color layer is a first colored layer, and on top of it, the upper color layer is arranged as a second colored layer which is a color layer that includes a plurality mixed colors printed consecutively to generate the print image, with the base color layer being narrower than the second colored layer, and wherein, starting from the surface of the three-dimensional object to be printed, a primer is provided as a first transparent or semi-transparent layer, onto which the first and second colored layers are applied, and wherein a coating is provided as a second transparent layer that is applied onto the second colored layer and is wider than the primer.

13. The container according to claim 10, wherein the container is a bottle or a can.

* * * * *